US011407582B2

(12) United States Patent
Hirsh et al.

(10) Patent No.: US 11,407,582 B2
(45) Date of Patent: Aug. 9, 2022

(54) SPILL CONTAINMENT SYSTEM FOR CONTAINER TANKS

(71) Applicant: Environmental Resolutions, Inc., Mount Laurel, NJ (US)

(72) Inventors: Joseph R. Hirsh, Mount Laurel, NJ (US); William H. Kirchner, Tabernacle, NJ (US)

(73) Assignee: Environmental Resolutions, Inc., Mount Laurel, NJ (US)

( * ) Notice: Subject to any disclaimer, the term of this patent is extended or adjusted under 35 U.S.C. 154(b) by 59 days.

(21) Appl. No.: 16/693,644

(22) Filed: Nov. 25, 2019

(65) Prior Publication Data

US 2021/0155401 A1 May 27, 2021

(51) Int. Cl.
*B65D 88/12* (2006.01)

(52) U.S. Cl.
CPC ..... *B65D 88/128* (2013.01); *B65D 2590/24* (2013.01)

(58) Field of Classification Search
CPC ..... B65D 88/128; B65D 1/34; B65D 88/129; B65D 2590/24
USPC ..... 220/1.5
See application file for complete search history.

(56) References Cited

U.S. PATENT DOCUMENTS 4,911,326 A 3/1990 McGouran, Jr.
5,114,046 A 5/1992 Bryant
5,273,180 A 12/1993 Whatley, Jr.
5,400,924 A 3/1995 Brodie
5,711,456 A 1/1998 Bryant
5,735,639 A * 4/1998 Payne ..... B65D 90/18 405/129.57
5,782,035 A * 7/1998 Locke ..... A01G 27/00 47/79
6,012,598 A * 1/2000 Antoniou ..... B65D 88/128 220/1.5
6,019,243 A 2/2000 Marino
6,231,247 B1 * 5/2001 Wrye ..... G03D 3/02 134/64 P
7,972,102 B2 7/2011 Ward et al.
8,376,178 B2 * 2/2013 Steinberg ..... D06F 39/081 220/571
9,903,505 B2 2/2018 Meints et al.
(Continued)

*Primary Examiner* — Anthony D Stashick
*Assistant Examiner* — Raven Collins
(74) *Attorney, Agent, or Firm* — Norman E. Lehrer

(57) ABSTRACT

A spill containment system for container tanks which include a liquid container and a steel frame surrounding the liquid container. The overall dimensions of the container tank are approximately twenty feet long, eight feet wide and eight and a half feet high. Beneath one or more stacked container tanks is a containment pan assembly including a liquid-tight pan having an interior capable of holding at least a portion of the contents of one liquid container. The containment pan assembly has an upper rectangular section that supports the container tanks and also has a length of about twenty feet and a width of eight feet. However, the entire height of the containment pan assembly is between eight inches and twenty-four inches. Additional similarly constructed containment pan assemblies are arranged adjacent the first assembly with hoses interconnecting the interiors of the several liquid-tight pans of the several containment pan assemblies.

8 Claims, 2 Drawing Sheets

(56) References Cited

U.S. PATENT DOCUMENTS

2002/0007602 A1* 1/2002 Corcoran ..... B65D 88/129
52/122.1

* cited by examiner

SPILL CONTAINMENT SYSTEM FOR CONTAINER TANKS

TECHNICAL FIELD

The present invention is directed toward a container tank containment system and, more particularly, toward an ISO tank containment system that is specifically designed to contain inadvertent leakage from one or more stored ISO container tanks. The inventive system allows the tanks to be stacked so as to take up a limited amount of storage space, while providing the containment required by various regulations.

BACKGROUND ART

ISO tanks have been used for many years to contain and transport various liquids from water to numerous kinds of flammable, poisonous, corrosive or other hazardous liquids. The tanks themselves are essentially cylindrically shaped and, according to the International Organization for Standardization (ISO), are 20 feet in length, 8 feet wide and 8 feet high. It is, of course, difficult to transport or otherwise handle tanks of this size and shape. For this reason, these tanks have been secured within steel frames. The tank and the frame are frequently referred to as container tanks and according to ISO standards are 20 feet in length, 8 feet wide and 8 feet 6 inches high. Examples of such container tanks can be seen in U.S. Pat. Nos. 6,012,598 and 9,903,505, the entire contents thereof are incorporated herein by reference.

By securing the tanks within a steel frame, the container tanks can be easily moved and transported in a manner similar to other known ISO containers. Such container tanks can also be easily stored on the ground either full or empty while waiting to be transported. In many cases, storage space is limited. Accordingly, the container tanks are frequently stacked on top of each other to save ground space. With lifting and moving equipment currently available, the container tanks may be stacked five high. This is the limit to which current equipment can reach.

As is well known in the art, many of the tanks contain hazardous chemicals. In the event of a leak, provisions must be made to prevent the hazardous liquid from reaching the ground and contaminating the same. The United States Environmental Protection Agency (EPA) and individual state departments of environmental protection (DEP's) have issued rules relating to possible leakage. According to these entities, provisions must be installed or constructed to capture leakage from the tank. These agencies require that the containment be capable of holding the volume of a tank plus six inches of height, or depth, to account for rain water for each footprint of a container tank. Because the requirement is based on the footprint of a container tank, it remains constant whether there is only one container tank or a stack of several container tanks, one above the other.

The most common solution is to construct a concrete basin to stack/store the field of container tanks. Another option would be to provide a basin or containment pan under the container tank that has a large enough volume to hold the contents of the tank plus the required six inches. If such a basin were essentially the same width and length of a tank, it would have to have a height of about six feet as a tank holds approximately 6,400 gallons. This six-foot height would interfere with the ability to stack the container tanks up to five tanks high. Lifts currently available would limit the stacking of the container tanks to three as they are not capable of reaching the height required to stack four containers on top of such a pan. Because ground storage space is limited and valuable, it would be of great benefit to have a system that meets the DEP requirements but still allows the container tanks to be stacked at least four high.

SUMMARY OF THE INVENTION

The present invention is designed to overcome the deficiencies of the prior art discussed above. It is an object of the present invention to provide a spill containment system that complies with DEP requirements.

It is another object of the present invention to provide a spill containment system that complies with DEP requirements and that allows for current lift equipment to stack container tanks up to five high.

This is accomplished by the present invention. In accordance with the illustrative embodiments demonstrating features and advantages of the invention, there is provided a spill containment system for container tanks which include a liquid container and a steel frame surrounding the liquid container. The overall dimensions of the container tank are approximately twenty feet long, eight feet wide and eight and a half feet high. Beneath one or more stacked container tanks is a containment pan assembly including a liquid-tight pan having an interior capable of holding at least a portion of the contents of one liquid container. The containment pan assembly has an upper rectangular section that supports the container tanks and also has a length of about twenty feet and a width of eight feet. However, the entire height of the containment pan assembly is between eight inches and twenty-four inches. Additional similarly constructed containment pan assemblies are arranged adjacent the first assembly with hoses interconnecting the interiors of the several liquid-tight pans of the several containment pan assemblies.

Other objects, features, and advantages of the invention will be readily apparent from the following detailed description of the preferred embodiment thereof taken in conjunction with the drawings.

DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
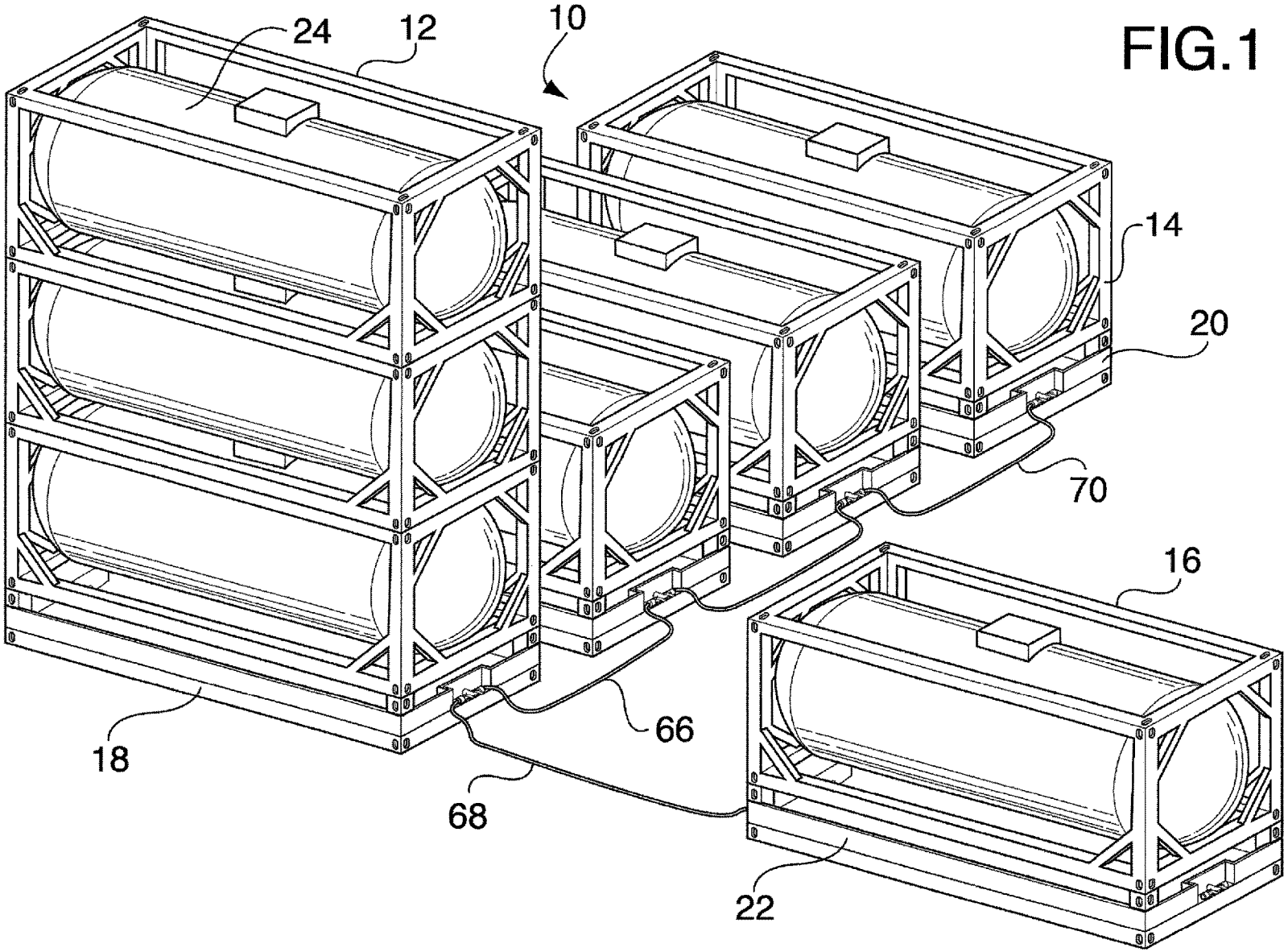
FIG. 1 is a front perspective view of a spill containment system for container tanks showing our new invention.

Referring now to the drawings in detail wherein like reference numerals have been used throughout the various figures to designate like elements, there is shown in FIG. 1 a spill containment system for container tanks constructed in accordance with the principles of the present invention and designated generally as 10. The spill containment system 10 is comprised essentially of two major components one or more container tanks 12, 14, 16, etc. and several containment pan assemblies such as shown at 18, 20, 22, etc. As should be apparent to those skilled in the art, although the tanks and containment pan assemblies are shown spaced some distance from each other in FIG. 1, this is for illustration purposes only. The spacing between the units can be substantially less, or more, as may be required or desired in any particular installation.

Figure 2:
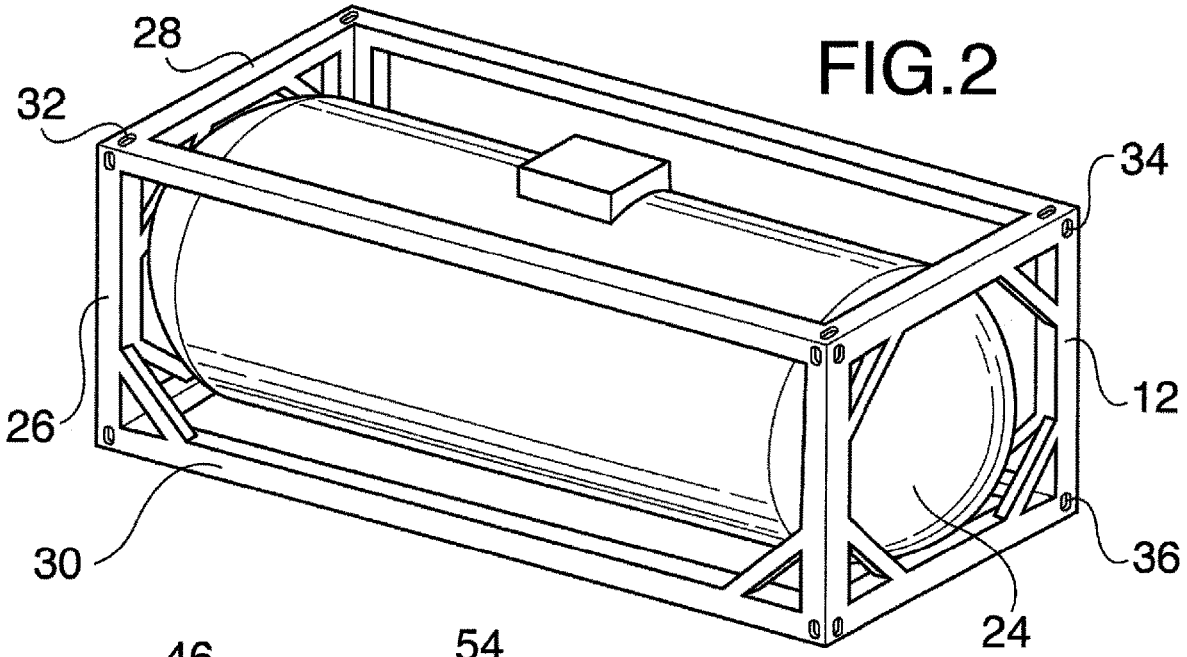
FIG. 2 is a front perspective view of a container tank that forms a part of the system of the invention.
Figure 3:
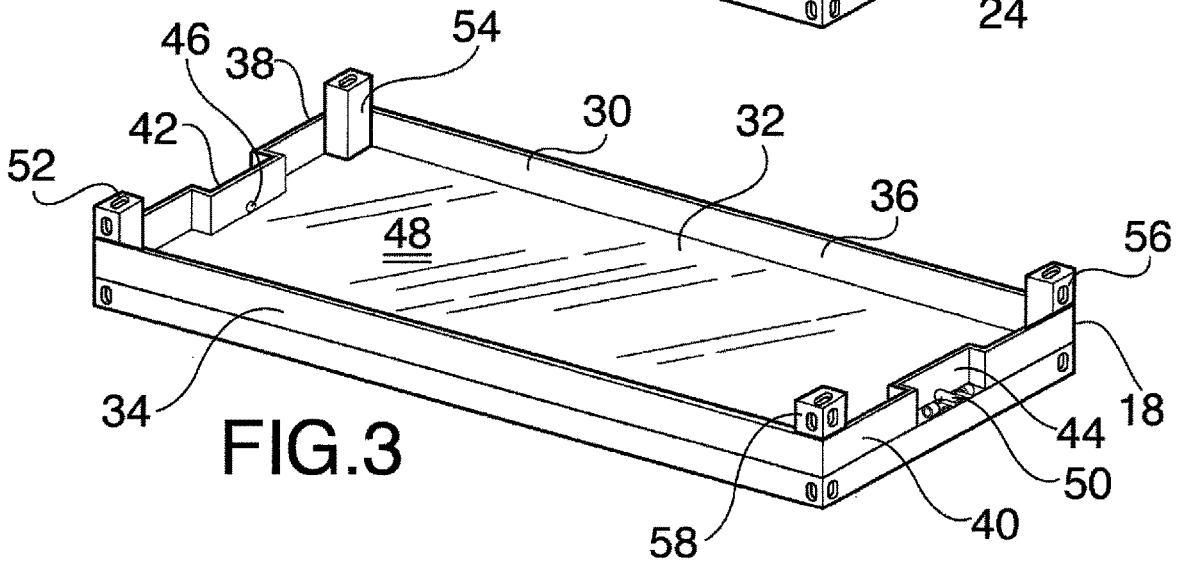
FIG. 3 is a perspective view of a basin or leak containment pan of the invention.
Figure 4:
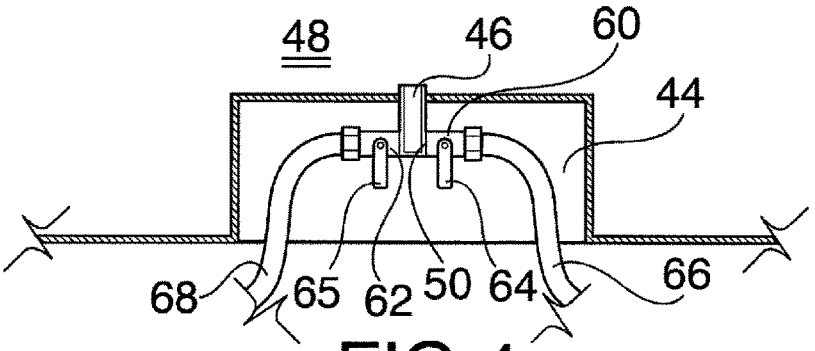
FIG. 4 is a top view shown somewhat schematically of a hose connection between two adjacent containment tanks.

FIGS. 2 and 3 show the container tank 12 and the containment pan assembly 18 which will now be described in some detail. While only these two components are being described, it will be understood that the description applies equally to each of the other container tanks 14 and 16 and each of the other containment assemblies 20 and 22.

The container tank 12 is of essentially conventional construction well known in the art and is comprised of a liquid container 24 and a steel frame 26 surrounding the tank or container 24. The frame 26 includes an upper rectangular frame member 28 and a lower rectangular frame member 30. A corner casting such as shown at 32, 34 and 36 is located at each of the eight corners of the frame 26. These corner castings are preferably added castings that are welded to the corners or could possibly be integrally formed with the corners. They allow the frame 26 to be secured to a transport vehicle (not shown) or to be secured to another frame or to substantially any other ISO container. Whether integrally formed or added by welding or the like, these corners will be referred to herein as corner castings.

As is well known in the art, the tank 24 is capable of holding 6,340 gallons or 24,000 liters of liquid. As is also well known in the art, the container tank 12 is twenty feet long, eight feet wide and eight and a half feet high. While there may be some slight variations in these dimensions, all container tanks are essentially the same. This allows the container tanks to be stacked one above the other as shown in FIG. 1. The corner castings allow the container tanks to be secured together if desired or merely function to allow a container tank to be supported above another.

The containment pan assembly 18 shown in FIG. 3, is comprised of a liquid-tight pan 30 formed of a bottom wall 32, front and back vertical walls 34 and 36 and end walls 38 and 40. Each of the end walls 38 and 40 includes a recessed section as shown at 42 and 44. An aperture such as shown at 46 passes from the interior 48 of the pan 30 to a pipe 50 on the exterior thereof but within the recess 42 or 44. The containment pan assembly 18 also includes corner castings such as shown at 52, 54, 56 and 58. These corner castings are adapted to mate with the corner castings 32, 34 and 36 at the bottom of the container tank 12.

Two of the dimensions of the containment pan assembly 18 are the same as the container tank 12. That is, it has a length of about twenty feet and a width of about eight feet. In this way, one or more container tanks can be stacked directly on top of a containment pan assembly as is apparent from FIG. 1.

However, and as pointed out above, the height of the containment pan assembly 18 is somewhat limited by the desire to stack multiple container tanks 12 on top of each other. It has been found that if the height of the containment pan assembly 18 is between eight inches and twenty-four inches, lifts and similar equipment currently available are capable of stacking up to five container tanks on a single containment pan assembly. This, however, creates a problem solved by the present invention.

Because the pan 30 is, at most, twenty-four inches deep, it is not capable of holding the entire contents of a tank 24 plus six inches of rain water as required by the DEP. To solve this problem, the invention utilizes two or more containment pan assemblies such as shown at 18, 20 and 22, etc. in FIG. 1. Each containment pan assembly includes the pipe 50 that splits into two interconnection pipes 60 and 62. Between the pipe 50 and each of the interconnection pipes 60 and 62 are valves 64 and 65, respectively. These can be any type of known valve for automatically or manually closing the ability of the pipe to communicate with hoses 66, 68, 70, etc. that interconnect the several containment pan assemblies. In this way, liquid released by any tank can fall into the containment pan below and then flow into any adjoining pan connected by a hose. To prevent interference and allow a stack of container tanks to be located close to each other, the pipes and valves are located within the recesses in the end walls of the containment pan assemblies. While not specifically shown, it will be understood that the pipes and recesses discussed above are preferably located at each end of each containment pan assembly.

The present invention may be embodied in other specific forms without departing from the spirit or essential attributes thereof and accordingly, reference should be made to the appended claims rather than to the foregoing specification as indicating the scope of the invention.

The invention claimed is:

1. A spill containment system for container tanks comprising: two or more container tanks each comprised of a liquid container and a steel frame surrounding said liquid container, said steel frame including an upper rectangular frame member and a lower rectangular frame member, each of said frame members including four corners and having a corner casting at each of said eight corners;

a plurality of containment pan assemblies including a liquid-tight pan having an interior capable of holding at least a portion of the contents of one of said liquid containers, said assembly having an upper rectangular section with four corners and a corner casting at each of said corners, said upper rectangular section having an outer perimeter size and shape that corresponds to the size and shape of the perimeter of said lower rectangular frame member of said steel frame of said container tank, whereby, said container pan assembly can support a container tank on said upper rectangular section with said corner castings of said lower frame member resting on said corner castings of said upper rectangular section, the height of said containment pan assembly being between eight inches and twenty-four inches; and a hose means interconnecting the interiors of the liquid-tight pans of said containment pan assemblies, thus creating the capacity required by regulations.

2. The spill containment system for container tanks as claimed in claim 1 wherein each of said container pan assemblies includes interconnection pipes for attachment to said hoses.

3. The spill containment system for container tanks as claimed in claim 2 wherein each of said pipe include valves associated therewith for opening and closing said pipes.

4. The spill containment system for container tanks as claimed in claim 3 wherein each of said container pan assemblies includes end walls with recesses therein and wherein each of said pipes includes a valve associated therewith for opening and closing said pipes, said pipes and valves being located in said recesses.

5. The spill containment system for container tanks as claimed in claim 1 including a plurality of container tanks stacked one on top of the other and mounted on top of said containment pan assembly.

6. The spill containment system for container tanks as claimed in claim 5 including a plurality of containment pan assemblies all constructed essentially the same as said first-mentioned containment pan assembly and hose means interconnecting the interiors of the liquid-tight pans of said containment pan assemblies.

7. The spill containment system for container tanks as claimed in claim 1 wherein each of said container tank and said containment pan assembly have a length of about twenty feet and a width of about eight feet.

8. A plurality of containment pan assemblies for a spill containment system for container tanks, each containment pan assembly including a liquid-tight pan having an interior capable of holding at least a portion of the contents of one of said liquid containers, said assembly having an upper rectangular section with four corners and a corner casting at each of said corners, said upper rectangular section having a length of about twenty feet and a width of about eight feet, said container pan assembly having a height of between eight inches and twenty-four inches and being capable of supporting a container tank on said upper rectangular section and hose means interconnecting the interiors of said liquid-tight pans.

* * * * *